United States Patent [19]

Alcorn

[11] 4,002,340

[45] Jan. 11, 1977

[54] GAME APPARATUS

[75] Inventor: LeForest V. Alcorn, Forestville, Conn.

[73] Assignee: The Raymond Lee Organization, Inc., New York, N.Y. ; a part interest

[22] Filed: June 26, 1975

[21] Appl. No.: 590,605

[52] U.S. Cl. ..... 273/131 A; 273/1 E; 273/130 AB

[51] Int. Cl.[2] ..... A63F 3/00

[58] Field of Search ..... 273/1, 130, 131, 134, 273/135, 138

[56] References Cited

UNITED STATES PATENTS

| | | | |
|---|---|---|---|
| 3,367,653 | 2/1968 | Brown | 273/1 E |
| 3,563,552 | 2/1971 | Korff et al. | 273/135 A |
| 3,584,875 | 6/1971 | Pickford | 273/134 A |
| 3,889,956 | 6/1975 | Castle | 273/138 A |
| 3,902,723 | 9/1975 | Colling et al. | 273/131 A |

*Primary Examiner*—Delbert B. Lowe
*Attorney, Agent, or Firm*—Daniel Jay Tick

[57] ABSTRACT

A housing is of rectangular parallelepiped configuration having a top and a bottom in spaced parallel relation, a first pair of sides in spaced parallel relation perpendicular to the top and bottom and a second pair of sides in spaced parallel relation perpendicular to the top and bottom and to the first pair of sides. Each of a pair of display panels is at a corresponding one of the first pair of sides of the housing and each has a plurality of display lamps thereon positioned in spaced relation in rows and columns, a pair of rotary switches thereon, a pair of ON-OFF switches and a pair of color indicating display lamps. A first plurality of spaced electrical contact sockets are positioned in a predetermined arrangement on the top of the housing. A second plurality of spaced electrical contact sockets are positioned on one of the second pair of sides of the housing. An electrical circuit electrically connects the second plurality of contact sockets to a memory circuit and electrically connects the first plurality of contact sockets and the lamps and switches of the display panels in a plurality of circuits via the memory circuit and a source of electrical energy. Each of a plurality of electrical contact plugs is removably insertable into any of the first plurality of contact sockets to make electrical contact therewith and thereby close selected ones of the circuits. Each of a plurality of programming units has an electrical contact plug and each is removably insertable into selected ones of the second plurality of contact sockets to program the memory circuit.

5 Claims, 17 Drawing Figures

FIG. 1
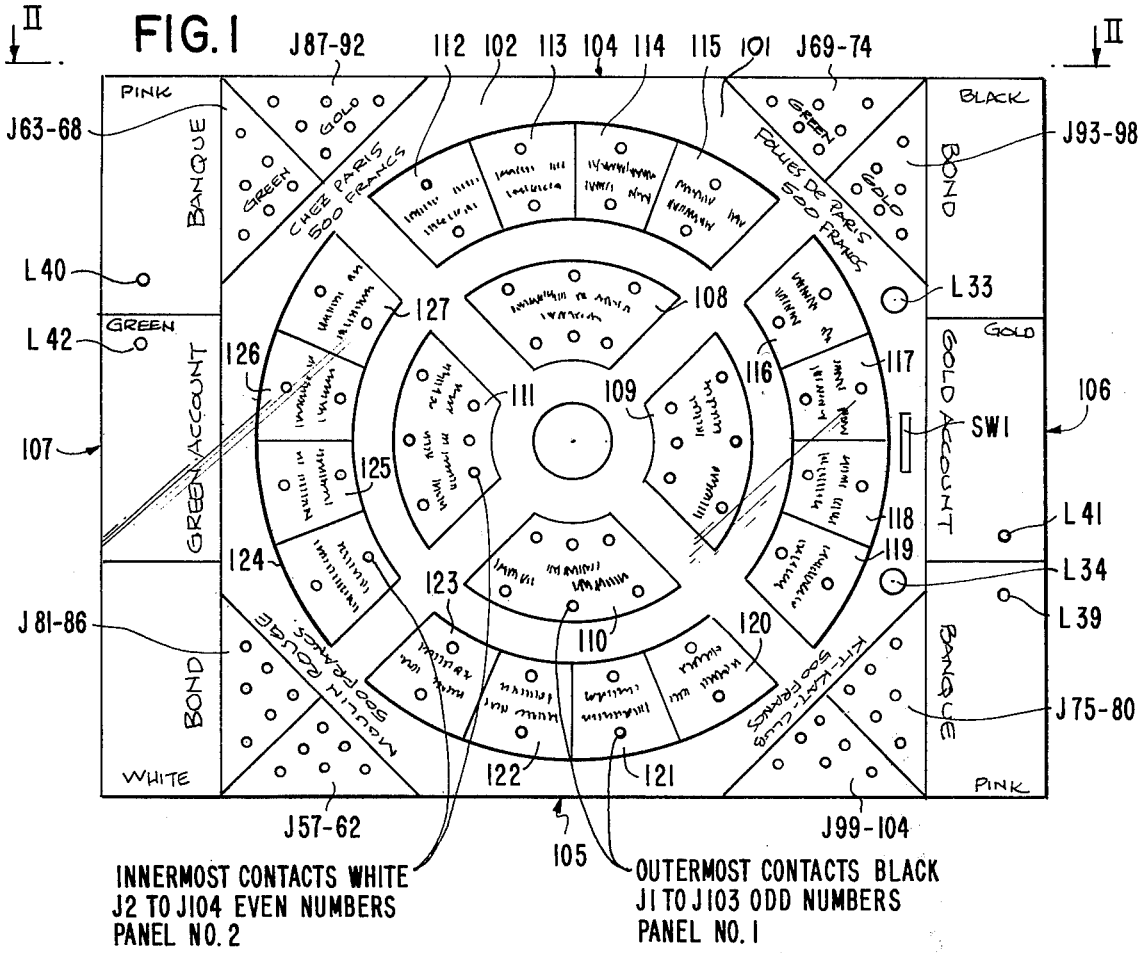
FIG. 2 DISPLAY PANELS 1 AND 2
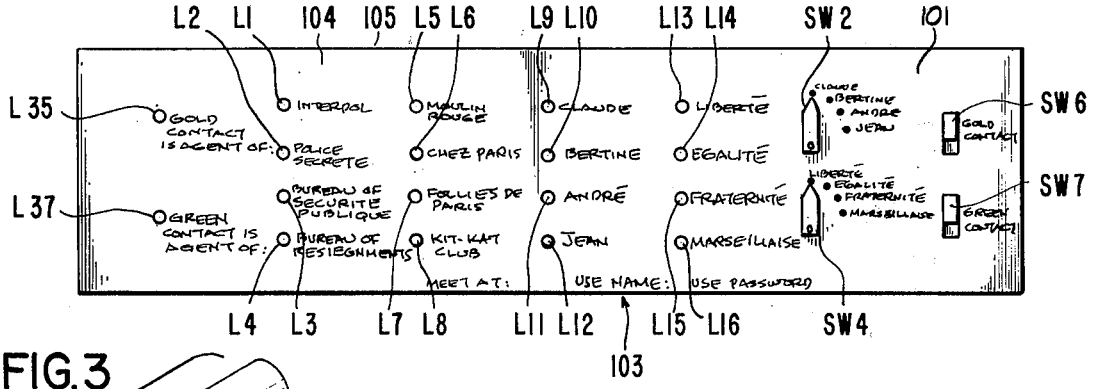
FIG. 3
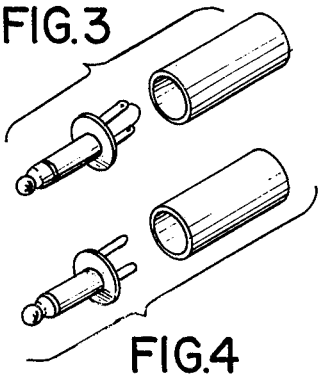
FIG. 4
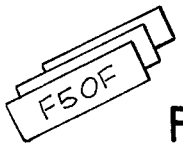
FIG. 5
FIG. 6
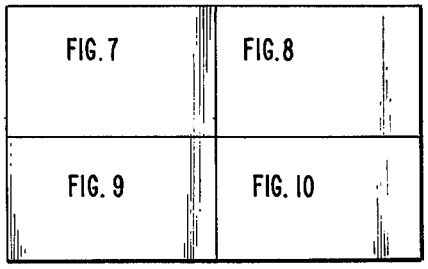

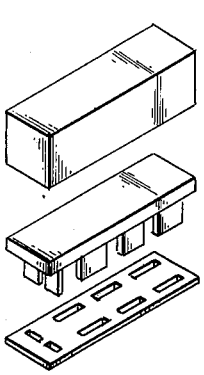
FIG. 11
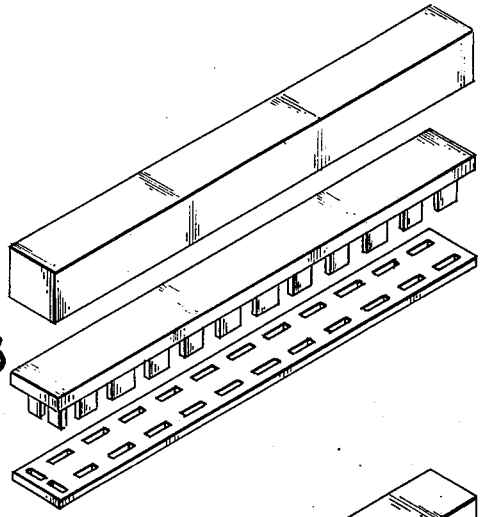
FIG. 13
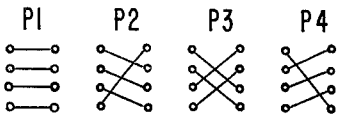
FIG. 12
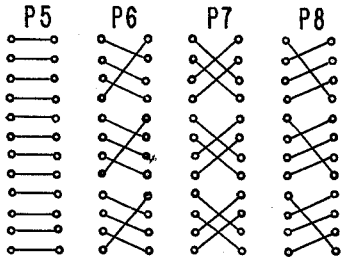
FIG. 14
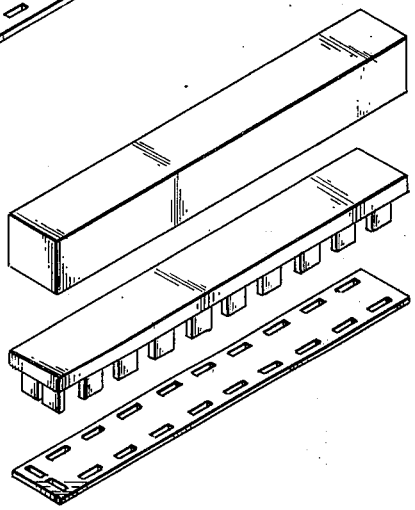
FIG. 15
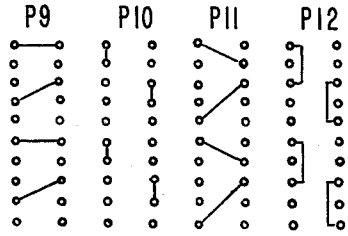
FIG. 16
FIG. 17
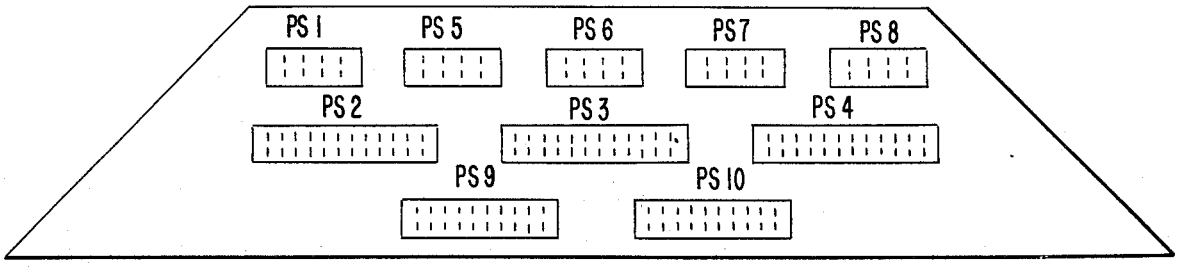

GAME APPARATUS

DESCRIPTION OF THE INVENTION

The present invention relates to game apparatus.

Objects of the invention are to provide game apparatus which provides entertainment, enjoyment, relaxation, interest, mental stimulation and amusement for participants and onlookers alike.

In order that the invention may be readily carried into effect, it will now be described with reference to the accompanying drawing, wherein:

FIG. 1 is a top plan of an embodiment of the game apparatus of the invention;

FIG. 2 is a side view, taken along the lines II—II, of FIG. 1;

FIG. 3 is an exploded perspective view of a spy plug of the game apparatus of the invention;

FIG. 4 is an exploded perspective view of a non-spy plug of the game apparatus of the invention;

FIG. 5 is a view of play money of the game apparatus of the invention;

FIG. 6 is a flow chart of the circuitry of the game apparatus of the invention, showing the relationship of the different portions of the circuit of FIGS. 7, 8, 9 and 10, in their relationship to each other to form the circuit of the invention;

Figure 7:
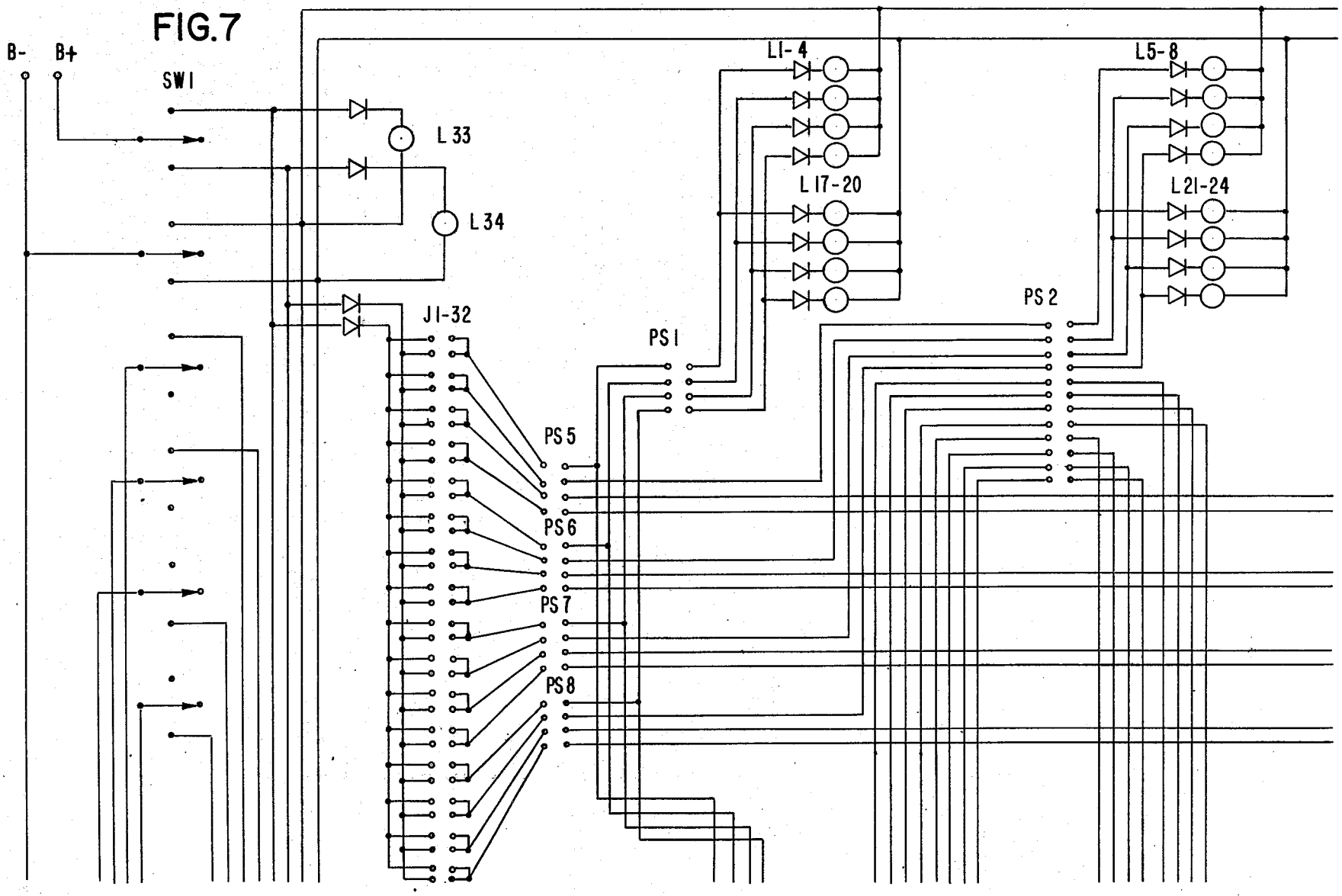
Figure 8:
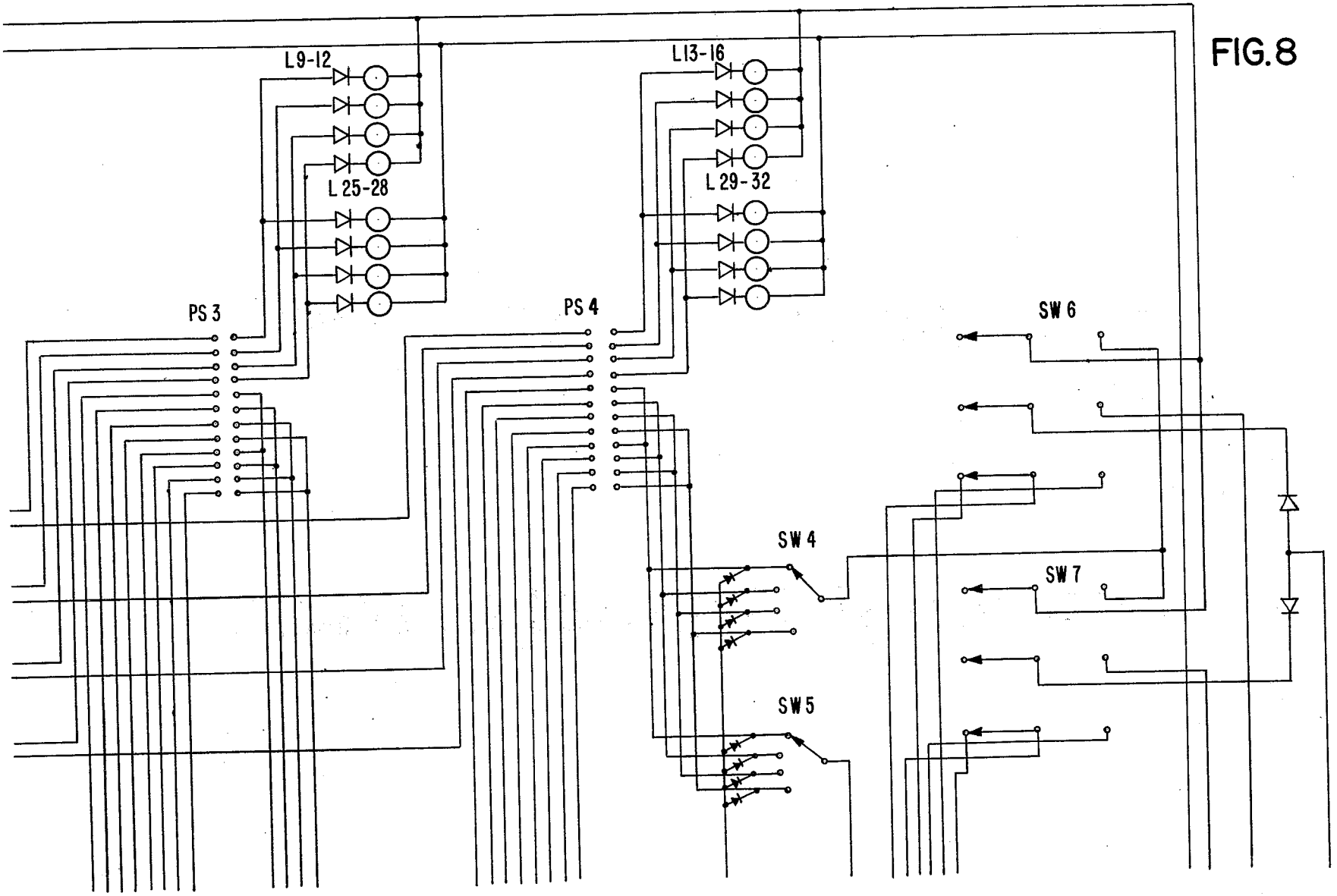
Figure 9:
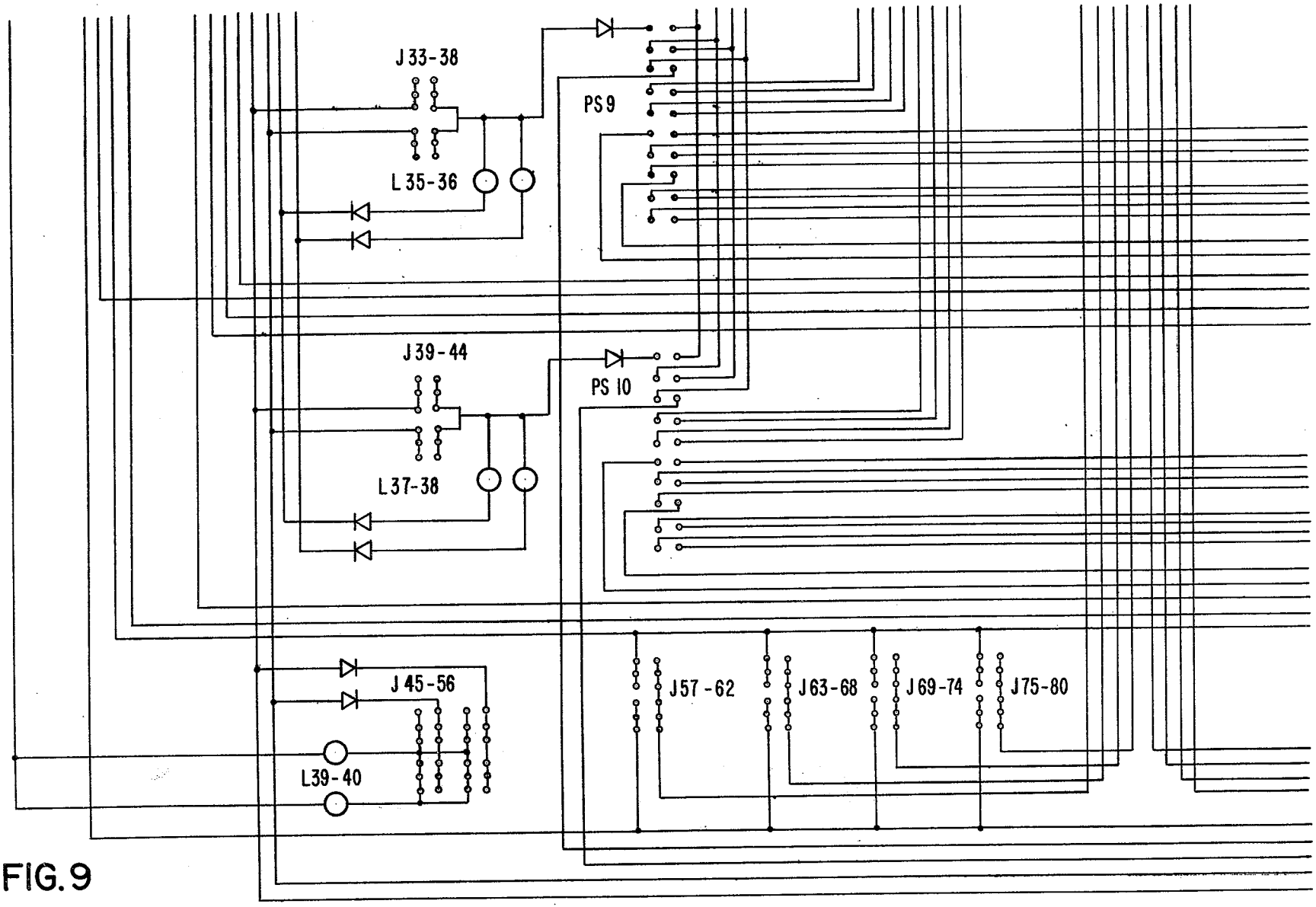
Figure 10:
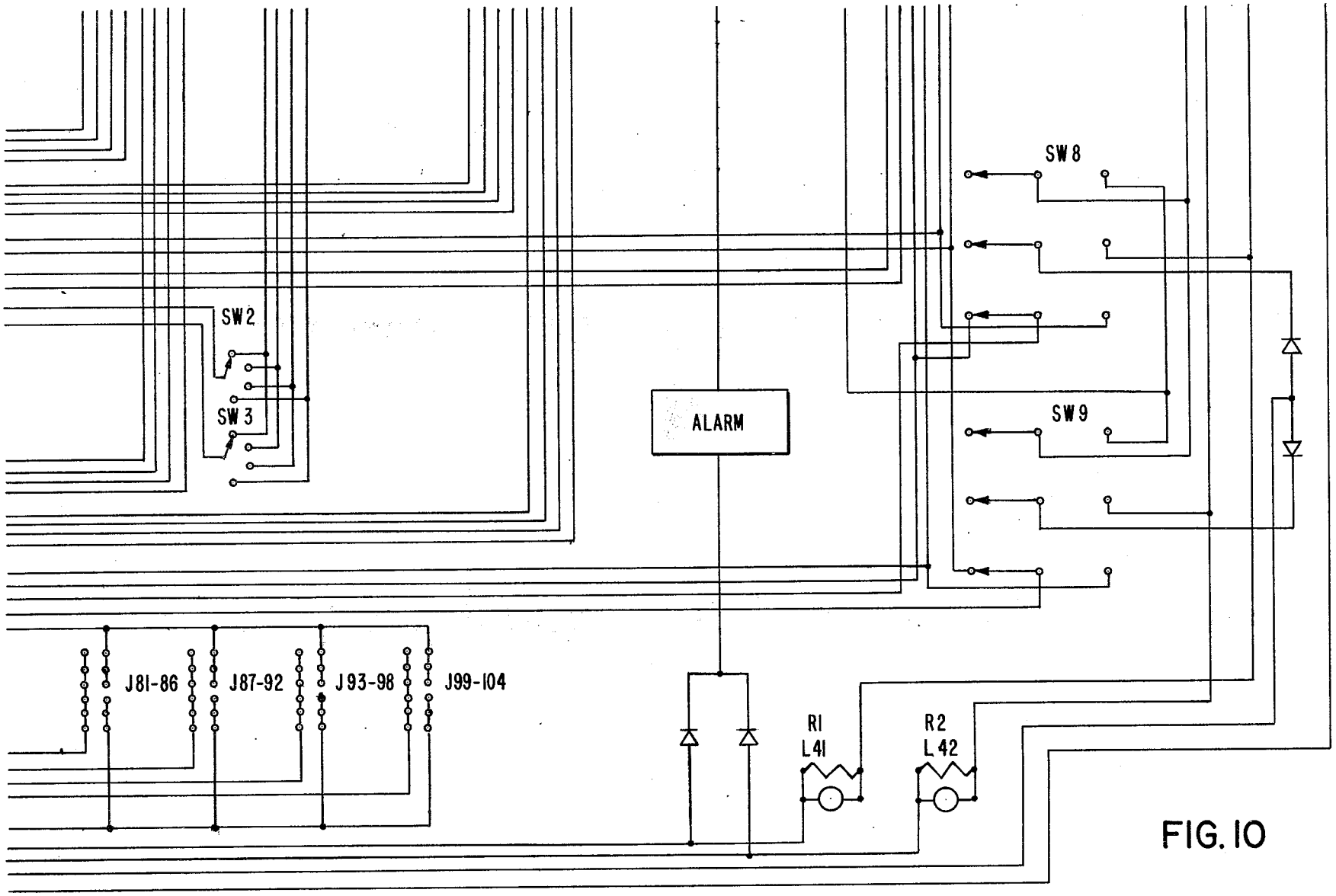

FIGS. 7, 8, 9 and 10, which together form one FIG., is a circuit diagram of the game apparatus of the invention;

FIG. 11 is an exploded perspective view of programming plugs;

FIG. 12 is a wiring diagram of the programming plugs of FIG. 11;

FIG. 13 is an exploded perspective view of programming plugs;

FIG. 14 is a wiring diagram of the programming plugs of FIG. 13;

FIG. 15 is an exploded perspective view of programming plugs;

FIG. 16 is a wiring diagram of the programming plugs of FIG. 15; and

FIG. 17 is a view of the side panel showing the placement of the programming sockets.

In the FIGS., the same components are identified by the same reference numerals.

The game apparatus of the invention comprises a housing 101 of substantially rectangular parallelepiped configuration having a top 102, a bottom 103 (FIG. 2) in spaced substantially parallel relation with the top, a first pair of sides 104 and 105 in spaced substantially parallel relation substantially perpendicular to the top and bottom, and a second pair of sides 106 and 107 in spaced substantially parallel relation substantially perpendicular to the top and bottom and to the first pair of sides, as shown in FIG. 1.

A pair of display panels Nos. 1 and 2, as shown in FIG. 2, are provided. Each of the display panels is provided at a corresponding one of the first pair of sides 104 and 105 and is preferably at an inclination inward toward the top so that it may be more easily seen by the players. As shown in FIG. 2, each of the display panels has a plurality of display lamps thereon positioned in spaced relation in rows and columns, a pair of rotary switches thereon, a pair of ON-OFF switches and a pair of color indicating display lamps.

A first plurality of spaced electrical contact sockets, indicated by small circles in FIG. 1, are positioned in a predetermined arrangement on the top 102 of the housing 101. As shown in FIG. 1, the contact sockets are distributed in eight triangular areas at the corners of a square. Four of the triangular areas are gold colored and four are green colored. One corner is labeled CHEZ PARIS — 500 Francs. Another corner is labeled Follies DE PARIS — 500 Francs. Another corner is labeled KIT KAT CLUB — 500 Francs and the last of the corners is labeled MOULIN ROUGE — 500 Francs.

Three substantially equal rectangular areas in linearly adjacent relation in the area of the side 106 on the top 102 are labeled BANQUE, GOLD ACCOUNT and BOND, respectively, and are colored, pink, gold and black, respectively. Three substantially equal rectangular areas in linearly adjacent relation in the area of the side 107 on the top 102 are labeled BANQUE, GREEN ACCOUNT and BOND, respectively, and are colored pink, green and white, respectively.

The central square of the top 102 of the housing 101 has a plurality of circular segments formed by four spaced concentric circles. The segments are in a first inner group of four spaced circular segments and a second outer group of four spaced circular segments. The four segments 108, 109, 110 and 111 of the inner group are labeled AUBERGE DE PARIS — 300 Francs, BANQUE DE FRANCE, LE BISTRO HENRI — 300 Francs and BANQUE DE PARIS, respectively, and are colored green, pink, gold and pink, respectively.

Each of the four segments of the outer group is divided into four equal segments, so that there are 16 segments in the outer group. The 16 segments 112, to 127 are labeled POSTE DE PARIS — 50 Francs, BOULANGERIE — 100 Francs, THEATRE DE PARIS — 200 Francs, HOTEL AMERICAIN — 400 Francs, colored orange, PHARMACIE — 50 Francs, MAISON DE VILLE — 100 Francs, GRANDE MAGAZINE — 200 Francs, HOTEL FRANCE — 400 Francs, colored avocado, BIBLIOTHEQUE — 50 Francs, CINEMA — 100 Francs, RESTAURANT — 200 Francs, HOTEL RITZ — 400 Francs, colored red, MUSEE HISTORIQUE — 50 Francs, CAFETERIA — 100 Francs, AGENCE DE VOYAGE — 200 Francs and HOTEL DE VILLE — 400 Francs, colored blue.

A second plurality of spaced electrical contact sockets are positioned on the side 107 of the housing 101.

A source of electrical energy which has, for example, any suitable type of battery or batteries, commercial power source or the like, and any suitable type of memory means or memory circuit are provided in the housing 101. An electrical circuit electrically connects the second plurality of contact sockets to the memory means and electrically connects the first plurality of contact sockets and the lamps and switches of the display panels in a plurality of circuits via the memory means and the source of electrical energy.

Each of a plurality of electrical contact plugs is removably insertable into any of the first plurality of contact sockets to make electrical contact therewith and thereby close selected ones of the circuits. Each of the electrical contact plugs comprises a housing of electrically insulative material having a plug extending from a surface thereof substantially perpendicular thereto, as shown in FIGS. 3 and 4.

A plurality of programming devices are provided. Each of the programming devices has electrical contact plugs and each is removably insertable into selected ones of the second plurality of contact sockets to program the memory means. Each of the programming devices comprises a housing of electrically insulative material having programming circuitry therein and plugs electrically connected to the programming circuitry and extending from a surface of the housing substantially perpendicular thereto, as shown in FIGS. 11, 13 and 15. Play money, as shown in FIG. 5, is provided.

An alarm device is connected in the circuit for indicating errors when portions of the circuit are incorrectly completed.

COMPUTER SPY

"Contact in Paris"

"Contact in Paris" is a spy game designed to present the player with some of the problems which might be encountered by a real life agent who found himself in a similar situation.

The problems faced by the agent may be generally classified as follows:

1. The need to maintain cover. To put it another way, the spy must be able to move around freely without exposing his true identity.
2. The need to obtain information pertinent to his mission with a minimum expenditure of time and money.
3. The need to obtain money. Not only must an agent obtain money to finance his travels but also he must obtain bond money before he can bring his opponent to a final defeat.
4. The need to expose the enemy agent. By studying and analyzing his opponent's moves an agent can, if he is astute, determine which of his opponent's characters is the enemy agent. Successfully arresting this enemy agent is the end accomplishment of a successful mission.

Keeping in mind the categorical problems just presented, the mechanics of the game may now be considered.

Mechanics of the Game

The game is played by two opponents facing each other over a playing board which is designed to represent a small corner of Paris with a number of establishments designated by name. The location of each establishment has at least two jacks (points of electrical connection for the spy pieces) while some locations have as many as six. Half of the jacks are painted white while the other half are painted black. The player on the white side of the board will use the white jacks and the player on the black side of the board will use the black jacks.

The playing board also presents each player with his own readout panel which is facing him and shielded so that it cannot be seen by his opponent. This readout panel will display information that the spy gathers in his travels. The panel also contains the "Name", "Password", and "Contact" switches which must be operated to complete a mission.

Each player has five characters with which to play the game. The base of each character is an electrical connection designed to fit the jacks of the playing board. These bases can be unscrewed and interchanged from one character to another. Of the five bases each player has, all are open circuited except one, (identified by a red marking) which will be used as a base for the character chosen to be the spy. Another base (open circuited) is identified by a blue marking. This will be the base for the character chosen to be the secret policeman. The other three characters will be ordinary civilians who are used primarily as shields to help the spy maintain his cover.

At the beginning of a game, each player will privately (out of sight of his opponent) select which character he wants to be his spy by placing it on the base with the red marking. He will also select which character he wants to be his secret policeman by placing it on the base with the blue marking. The unmarked bases will go on the remaining three characters. The opponents are now ready to start playing the game.

A toss of a coin can determine which player starts off first. The first player then places his five characters in any five of the establishments, except night clubs which cannot be entered until a bond has been posted. The player then pays the travel expenses of his five characters (more on this subject later) by placing the money in either the area marked "Gold Account" or the area marked "Green Account". The player can then move the master switch lever toward his side of the board, which activates his readout panel and gives him the information obtained by his spy. It is important that the characters always be placed in their new positions before the master switch is activated because in some cases (such as when the spy is being placed in a bank) the indentity of the spy can be revealed if the spy character is moved after the master switch is activated.

After the first player has noted the information on his readout panel, the second player takes his turn and so on alternately for the rest of the game.

Objectives

Since the game is won by the player who manages to arrest his opponent's spy, it is important that this be the primary objective and all other action in the game is designed to make possible and bring about this result.

In order to make an arrest a player must place his secret policeman in the same location (building) as the character to be arrested. The player then announces that he is making an arrest and reveals the identity of his policeman by removing it from its base and showing the blue marking. His opponent must then remove the character being arrested from its base and show its marking, if any. If the marking of the arrested character is red then he is the spy and the game is over.

If the character arrested has no marking at all then he is an ordinary civilian and the game goes on. However, a false arrest has been made and a fine of 5000 francs must be paid by the player making the arrest. This fine is paid directly to his opponent.

If the character arrested has a blue marking then he is a secret policeman and the game still goes on. However, a false arrest has been made and because arresting an opposing officer is a doubly serious offense, a fine of 10,000 francs must be paid by the player making the arrest. This fine is paid directly to his opponent.

It should be obvious at this point that the arrests are made by the secret policeman so that the spy can keep his identity secret if a false arrest is made.

It should also be obvious at this point that an arrest should not be made unless the player making the arrest is able to pay any fine he might incur by making a false arrest. The player automatically certifies to this by posting bond money.

A bond of 10,000 francs is required before an arrest can be made. If a fine is paid causing the bond to drop below the 10,000 franc amount, no other arrests can be made until the posted bond is again brought up to the required 10,000 francs.

The need to post such a large bond before the climactic plays of the game can be attempted is the incentive for a player to use his spy in an effort to accomplish one or more missions. Only by successfully completing a mission can a player be certain of obtaining a large amount of money.

Missions

Each game presents the spy with two missions which he may attempt. Both missions are similar in that all he has to do is make contact with another friendly agent. The two friendly agents are known only by their code designations "Gold" and "Green". In order to make contact with either of the two friendly agents, a spy must first learn four necessary bits of information.

The first bit of information which the spy must learn is to which of four government agencies does the friendly agent belong. The four government agencies are; Interpol, Police Secrete, Bureau de Securite Publique, and Bureau de Renseignements.

In order to determine which agency is the correct one it is first necessary to decide which agent, "Gold" or "Green", is to be contacted.

If the "Gold" agent is to be contacted, a visit to "Le Bistro Henri" is necessary. "Le Bistro Henri" is a "safe house" for "Gold Mission" agents. A visit to "Le Bistro Henri" by the inquiring spy will reveal on the display panel to which government agency the "Gold" agent belongs.

On the other hand, if the "Green" agent is to be contacted, a visit to "Auberge de Paris" is necessary. "Auberge de Paris" is a "safe house" for "Green Mission" agents. A visit to "Auberge de Paris" by the inquiring spy will reveal on the display panel to which government agency the "Green" agent belongs.

Now, having learned to which agency the friendly agent belongs, the spy can proceed to obtain the other three bits of information necessary to make a contact.

The spy must now travel around visiting various establishments on the board. These establishments are gathered into groups of four. Each group is identified by its own distinctive color. The group colors are; Red, Orange, Blue, and Avocado. In addition to the four groups just mentioned there are four night clubs, each of which is divided in half, with one half colored Gold and the other half colored Green. These night clubs do not dispense information; they are rendezvous places only.

The spy must now travel around, gathering a bit of information (which is displayed on the panel) from each establishment until he comes to one which declares itself a member of the same government agency to which the "Gold" agent belongs. The spy now knows that he has contacted the group with which the "Gold" agent works. By visiting other members of that same group (establishments with the same color) the spy can learn in which meeting place (night club) the contact is to take place. He can also learn what name and password are to be used in order to make a successful contact.

In order to complete the "Gold" contact the spy must now visit the "Gold" half of the night club (meeting place) that was designated.

At this point the player must now set the "name" switch on the readout panel to the name which was designated and the "password" switch to the password which was designated.

If all is correct, that is, the spy is in the "Gold" area of the contact night club, and the name and password switches are set correctly, then contact can be made.

Contact is made by the player actuating first the master switch then the "Gold Contact" switch. If all has been carried out correctly, the "Gold" lamp will light on the playing board and the player will collect the award contained in the "Gold Account" area.

Obviously, if a player wishes to complete the "Green" mission, the procedure is the same except that the spy must find the group of establishments with which the "Green" agent works and from them learn the name, password, and meeting place to be used. The spy is then placed in the "Green" area of the contact night club and the "name" and "password" switches set to the names designated. If all is correct, the master switch and "Green Contact" switches are actuated and the "Green" lamp on the playing board will light. The player will collect the award contained in the "Green Account" area.

As the spy travels around the board, various bits of information pertaining to the mission will be revealed. However, it is important to remember that not all the information received is useful. Only the information revealed by the groups associated with the "Gold" and "Green" agents is useful. Any information given by groups not associated with the "Gold" or "Green" agents is of no value at all.

In the event that a contact is not correctly made because of some error in name, password, or meeting place, an alarm will sound when the contact switch is actuated.

When this alarm sounds it indicates that an unsuccessful attempt at contact has been made and since it was unsuccessful, a fine of 2000 francs must be paid directly to the opposing player. The unsuccessful player must also remove his characters from the night club areas on the next move.

In order to insure that a player is able to pay any fine incurred, it is required that a bond of 2000 francs be posted before he is allowed to move any of his characters into any night club.

If an unsuccessful attempt causes a fine to be paid and the bond money drops below the 2000 franc level, additional money must be deposited to bring the bond up to 2000 francs before any characters can again be moved into any of the night clubs.

Finances

It is now necessary to consider the financial aspects of the game.

When a player moves his characters about the board from one establishment to another, he must pay their traveling expenses. Each establishment, except the banks, is labeled with its name and amount of money. The amount of money is the amount that each character must spend upon each visit to the establishment. For example; a character visiting "Le Bistro Henri" or "Auberge de Paris" will have to pay 300 francs. A visit to "Hotel France" costs 400 francs, while a visit to the "cinema" costs 100 francs. Visiting any of the night clubs costs 500 francs, etc., etc..

These traveling expenses must be paid for each character as each move is made. The money paid must be placed in either the "Gold Account" or the "Green Account". These accumulated funds are the awards which are collected by a spy who has accomplished a successful mission.

In other words, a spy who successfully contacts the "Gold" agent collects the funds in the "Gold Account". Likewise a spy who successfully contacts the "Green" agent collects the funds in the "Green Account".

Each player starts out with 2000 francs travel expenses. However, this does not last long if he is moving five characters at a time, so there must be some means of obtaining additional travel expenses from time to time.

The two banks, "Banque de France" and "Banque de Paris" provide a means of obtaining additional travel money. Although he may take other civilian characters with him to maintain his cover, the spy is the only character that can obtain money from the banks. When a spy is in either bank, the lamps in the bank areas will light, indicating that a withdrawal of money is allowed. This withdrawal is to be made from the total bank funds (shared by both banks) which at the beginning of the game consists of all the money used in the game except the 2000 francs each player starts out with.

A spy may withdraw 2000 francs upon each visit to the bank; however, he cannot visit the banks more often than once every four moves. In other words, after having withdrawn money, the spy must stay outside of the banks for the next three moves. After those next three moves the spy may, if desired, return for another withdrawal.

Another rule of the banks is that no character may be allowed to loiter in the banks for longer than one move. Any character having entered the bank on one move must be removed to some other location (not to the other bank) on the very next move.

In the case of a spy entering a bank accompanied by several civilians as shields, all of them must be removed to some non-bank location on the very next move.

This no-loitering rule applies only to the banks. Characters may remain in other locations as long as desired after paying their initial entrance fee.

Travel expenses and the initial 2000 franc bond will have to be collected by occasional visits to the banks. Any additional funds which a player may receive in the form of fines paid by his opponent may be used either for travel expenses or bond money.

Programming

The Computer Spy game is equipped for computer-like programming by means of a number of sockets mounted on a side panel, into which are fitted a selection of plugs. The internal wiring of the plugs provides the programming for each game. There are many more plugs provided than there are sockets. The object is to provide random programming by mixing all the plugs before each game and then selecting at random enough plugs to fill the sockets.

This insures that the information for each game will be different. The groups associated with the "Gold" and "Green" missions will vary from game to game. Also, the information pertaining to the missions will vary and with the exception of the "safe houses", the location at which particular bits of information may be found will vary from game to game.

If both "Gold" and "Green" missions are accomplished and no spy has been arrested, the programming plugs may be pulled and rescrambled and the game reprogrammed by mutual agreement of the players. At this point the game proceeds, but with all new information pertaining to the "Gold" and "Green" missions so that both missions may be accomplished anew.

Strategy

Since the object of the game is for a player to arrest his opponent's spy, it should be obvious to a player that his opponent is studying every move in an attempt to discover which character is a spy and is therefore the one to be arrested.

The use of the policeman and civilian characters as shields is a good way of protecting a spy's identity. This is accomplished by having one or more non-spy characters visit every establishment that the spy visits. Also, whenever a spy visits a bank he should be accompanied by several, if not all, of his companion characters. It should be noted that the two banks together have enough positions for all five characters and it would be impossible to tell which of the five was a spy.

Whenever an attempt is made to contact either a "Gold" or "Green" agent, the spy must enter the night club designated as the meeting place. Since each section of a night club will accommodate only three characters, a spy attempting a contact should take two non-spy characters with him as shields. It is important to do this because if the opposing player knows which is the correct meeting place for this contact he will be able to identify the spy if the spy is not accompanied by shields. He would not even have to know the correct meeting place if no other meeting place were occupied.

Although it is not necessary to move every character on every turn, it is important that the non-spy characters be moved often enough so that the spy will not stand out as the only one moving around.

Looking at the game from the opposite point of view, it is just as important for a player to be able to detect his opponent's spy as it is to be able to conceal his own. Sometimes it will be possible to reduce the number of possible spies by a process of elimination. Knowing that only a spy can make a withdrawal from a bank, a player can eliminate from the possibility of being a spy, any characters which are not in a bank at the time a withdrawal is made.

Also, knowing that only three characters can be in the correct meeting place at the time a "contact" is made, makes it advisable in some cases to try to determine which was the correct meeting place, even if the opponent has already collected the award, so that at least two characters who were not in the correct meeting place can be eliminated from the possibility of being a spy. This would be unnecessary, of course, if the other two characters were not in any night club at all.

The previously mentioned methods are ways of eliminating characters who cannot possible be a spy. In addition to these methods there are things to look for that might indicate a character who is likely to be a spy.

The things to look for are:

1. A character who seems to be doing much more moving around than any of the others.

2. A character who seems to be the only one to visit the more expensive establishments.

3. A character who seems to be spending more money than the others.

Things to look for that might indicate that a character is not a spy are:

1. A character who does little moving around.
2. A character who never visits a "safe house".
3. A character who never visits expensive establishments.
4. A character who spends little money.
5. A character who "sits out" turns frequently.

It must be remembered that the previously listed indicators to look for are not infallible. Since this is a game of strategy, it is possible for a player to alter appearances to evoke a false conclusion. For example; if a player were to consistently move his policeman more frequently than any of the other characters, including his spy, then the indicator would point to the policeman as being the spy. An opponent making an arrest on this evidence alone would have to pay a heavy fine.

Since this is a game of strategy and the strategy is determined by the players, this game can be as simple or as sophisticated as the players themselves and, as in real life, it never pays to underestimate an opponent.

Description of Circuit

The components which make up the Computer Spy game can be grouped together according to areas in which they are located. The first group would contain those elements which appear on the two readout panels (one panel facing each player). The second group would contain those elements which appear on the playing board (horizontal surface upon which the game is played). The third group would contain those elements which appear on a side panel for the purpose of programming the logic circuits.

Although the two readout panels are identical in every respect, the components which are located on them are labeled separately on the schematic diagram. The first panel shall be called panel No. 1 and the second panel No. 2.

Starting on the left of panel No. 1 the first components are two lamps (L35 and L37) located one above the other. The upper one is labeled "Gold Contact is agent of" and the lower one is labeled "Green Contact is agent of". Immediately to the right is a vertical column of four lamps (L1 through L4). From top to bottom these are labeled:

1. Interpol
2. Police Secrete
3. Bureau de Securite Publique
4. Bureau de Renseignements Further to the right is another vertical column of four lamps (L5 through L8). From top to bottom these are labeled:

5. Moulin Rouge
6. Chez Paris
7. Follies de Paris
8. Kit Kat Club

Further to the right is another vertical column of four lamps (L9 through L12). From top to bottom these are labeled:

9. Claude
10. Bertine
11. Andre
12. Jean

Further to the right is another vertical column of four lamps (L13 through L16). From top to bottom these are labeled:

13. Liberte
14. Egalite
15. Fraternite
16. Marseillaise

Further to the right are two four position switches (SW2 and SW4) located one above the other. The upper one has its four positions labeled:

1. Claude
2. Bertine
3. Andre
4. Jean

The lower one has its four positions labeled:

1. Liberte
2. Egalite
3. Fraternite
4. Marseillaise

Further to the right are the final two switches (SW6 and SW7) on the panel. Located one above the other, the upper one is labeled "Gold Contact" and the lower one is labeled "Green Contact".

The display and labeling on panel No. 2 is identical to that on panel No. 1; however, the components are labeled on the schematic as L36, L38, L17 through L32, and SW3, SW5, SW8, and SW9.

The surface of the playing board also has a number of components, the most prominent of which is the master switch SW1 with its associated lamps, L33 to indicate when panel No. 1 is energized and L34 to indicate when panel No. 2 is energized. Also on the playing board (off to one side) are two areas labeled "Banque" each with an indicating lamp (L39 and L40). Also on the playing board (off to one side) is the "Gold Account" area with its lamp (L41) and the "Green Account" area with its lamp (L42). In addition to the areas of the playing board which have lamps, there are 24 labeled areas containing electrical contacts. Although these contacts are closed only by the spy characters, they are used as playing positions by all the characters on the board. The electrical contacts are always in pairs. One contact of the pair is connected to the circuit associated with panel No. 1 and the other contact of the pair is connected to the circuit associated with panel No. 2. The contacts associated with panel No. 1 are identified by a distinctive color and are used only by the player facing panel No. 1. The contacts associated with panel No. 2 are also identified by their own distinctive color and are used only by the player facing panel No. 2.

In the playing area there are two banks, one is labeled "Banque de Paris" and the other "Banque de France". Each of these banks has three pairs of electrical contacts making 12 contacts altogether, six of which are associated with panel No. 1 and the other six associated with panel No. 2 (J45 through J56). If a spy character happens to be located in one of these positions when the panel it is associated with is energized, the lights (L39 and L40) in both "Bank" areas will light up, indicating that a withdrawal of money can be made.

Also in the playing area there are two inns each with three pairs of electrical contacts. One inn, colored gold, is labeled "Le Bistro Henri" and contains contacts J33 through J38. When a spy character is positioned in one of the contacts associated with panel No. 1, and that panel is energized, lamp L35 will light and also one of the lamps (L1 through L4) in the first vertical column. This will indicate that the "Gold Contact is an agent of" one of the four agencies listed in the first vertical column. When a spy character is positioned in one of the contacts associated with panel No. 2, and that panel is energized, lamp L36 wll light and also one of the lamps (L17 through L20) in the first vertical column. This will give on panel No. 2 the same information in regard to the "Gold Contact" that was just described for panel No. 1.

The other inn in the playing area is colored green and is labeled "Auberge de Paris". It contains contacts J39 through J44. When a spy character is positioned in one of the contacts associated with panel No. 1, and that panel is energized, lamp L37 will light and also one of the lamps (L1 through L4) in the first vertical column. This will indicate that the "Green Contact is an agent of" one of the four agencies listed in the first vertical column. When a spy character is positioned in one of the contacts associated with panel No. 2, and that panel is energized, lamp L38 will light and also one of the lamps (L17 through L20) in the first vertical column. This will give on panel No. 2 the same information in regard to the "Green Contact" that was just described for panel No. 1.

Also in the playing area there are located four groups of buildings. The buildings are labeled as representing various establishments such as cinema, Hotel Ritz, cafeteria, etc.. Each building has one pair of electrical contacts making for a total of eight electrical contacts in each group of buildings. Each group of buildings is identified by its own distinctive color. The pair of electrical contacts in each building is connected through the circuit to one of the lamps in one of the four vertical columns on the display panels (exactly which lamp and which column will vary from one game to the next as will be described later).

The first group of four buildings contains four pairs of electrical contacts (J1 through J8), four contacts associated with panel No. 1 and four contacts associated with panel No. 2.

The second group of four buildings contains four more pair of electrical contacts (J9 through J16). Four contacts for panel No. 1 and four for panel No. 2.

The third group of four buildings contains four more pairs of electrical contacts (J17 through J24). Four contacts for panel No. 1 and four for panel No. 2.

The fourth group of four buildings contains four more pair of electrical contacts (J25 through J32). Four contacts for panel No. 1 and four for panel No. 2.

Also in the playing area there are four night clubs. The night clubs are labeled:

1. Moulin Rouge
2. Chez Paris
3. Follies de Paris
4. Kit Kat Club

The four night clubs are each divided in half. One half of each night club is colored gold and the other half is colored green. Each half of each night club contains three pairs of electrical contacts for a total of six contacts in each half, three contacts associated with panel No. 1 and three contacts associated with panel No. 2.

The three pair of contacts in each "Gold" half of the night clubs are as follows:

1. Moulin Rouge — J81 through J86
2. Chez Paris — J87 through J92
3. Follies de Paris — J93 through J98
4. Kit Kat Club — J99 through J104

The three pair of contacts in each "Green" half of the night clubs are as follows:

1. Moulin Rouge — J57 through J62
2. Chez Paris — J63 through J68
3. Follies de Paris — J69 through J74
4. Kit Kat Club — J75 through J80

The electrical contacts in the four night clubs are used by the spy characters to make their final contact with the "Gold" or "Green" agents. These contacts represent links in the logic circuitry. The proper link must be closed (by the spy character occupying a position in the correct night club) in order for the logic circuitry to be completed. If the "Gold" logic circuitry is correctly completed, lamp L41 will light when the contact switch (SW6 for panel No. 1 or SW8 for panel No. 2) is closed. If the "Green" logic circuitry is correctly completed, lamp L42 will light when the contact switch (SW7 for panel No. 1 or SW9 for panel No. 2) is closed.

If the logic circuits are not correctly completed, the alarm will sound when the contact switch is closed.

The heart of the computer spy game is the logic circuitry which makes it possible for the information to be arranged in different combinations for every game played. This logic circuitry is governed by a "memory" which consists of 10 multiple contact sockets (located on a side panel) into which are inserted a random assortment of prewired plugs. There are three types of plugs and sockets used. The first type is an eight contact plug and socket. These eight contact sockets are shown on the schematic as PS1, PS5, PS6, PS7, and PS8. The wiring for the plugs that fit these sockets is shown on the plug schematic as P1, P2, P3, and P4. Five plugs of each of these wiring modes should be available in order to have enough for every possible arrangement in the five 8 contact sockets.

The second type of plug and socket combination is a 24 contact plug and socket. These 24 contact sockets are shown on the schematic as PS2, PS3, and PS4. The wiring for the plugs that fit these sockets is shown on the plug schematic as P5, P6, P7, and P8. Three plugs of each of these wiring modes should be available in order to have enough for every possible arrangement in the three 24 contact sockets.

The third type of plug and socket combination is a 20 contact plug and socket. These 20 contact sockets are shown on the schematic as PS9 and PS10. The wiring for the plugs that fit these sockets is shown on the plug schematic as P9, P10, P11, and P12. One of each of these wiring modes is all that is needed for these two 20 contact sockets.

The logic circuitry can be divided into two parts. The first part determines the distribution of the information displayed on the display panels. The second part determines the arrangement of the "Gold" and "Green" award circuits. Obviously, the first and second parts must always be in precise agreement.

The information distribution starts at the four groups of buildings. The first group of four buildings has electrical contacts J1 and J2 in the first building, J3 and J4 in the second building, J5 and J6 in the third building, and J7 and J8 in the fourth building. The odd numbered contacts are for panel No. 1 and the even numbered contacts are for panel No. 2. When a spy character closes the contacts (completes the electrical circuit) of J1 or J2, the circuit is complete from the B plus (positive) end of the power supply to the first contact of PS5. If PS5 is occupied by a P1 plug the circuit is completed straight through to the first contact of PS1. If PS1 is occupied by a P1 plug the circuit is completed straight through to the lamps L1 and L17, the other sides of which are connected to the B minus (negative) end of the power supply. When the master switch is closed, either L1 or L17 will light, indicating the agency to which that group of buildings belongs.

Following through in the same manner from contacts J3 and J4 the circuit will lead to PS2. If PS2 is occupied by a P5 plug the circuit will lead to lamps L5 and L21 which will indicate the meeting place (night club) recommended by that particular group.

Following through in the same manner from contacts J5 and J6 the circuit will lead to PS3. If PS3 is also occupied by a P5 plug the circuit will lead to lamps L9 and L25 which will indicate the name to be used if this group is the correct one for an award contact.

Following through in the same manner from contacts J7 and J8 the circuit will lead to PS4. If PS4 is also occupied by a P5 plug the circuit will lead to lamps L13 and L29 which will indicate the secret password to be used if this group is the correct one for an award contact. This completes the information distribution for the first group of four buildings.

The second group of four buildings contains electrical contacts J9 through J16. Following through in a manner similar to that just described for the first group of buildings will show that the circuit leads to lamps L2 and L18 in the agency column, L6 and L22 in the meeting place column, L10 and L26 in the name column, and L14 and L30 in the password column.

The third group of buildings contains electrical contacts J17 and J24. This time the circuit will lead to lamps L3 and L19 in the agency column, L7 and L23 in the meeting place column, L11 and L27 in the name column, and L15 and L31 in the password column.

The fourth group of buildings contains electrical contacts J25 through J32. This time the circuit will lead to lamps L4 and L20 in the agency column, L8 and L24 in the meeting place column, L12 and L28 in the name column, and L16 and L32 in the password column.

The foregoing is a fundamental description of the information distribution circuit. The information distributed by each group of buildings will vary from one game to the next, however, depending upon which plugs occupy PS1, PS2, PS3, and PS4. For example, if the P1 plug were removed from PS1 and replaced by a P2 plug the lead which originally went to L1 and L17 will now go to L2 and L18. The lead that originally went to L2 and L18 will now go to L3 and L19. The lead that originally went to L3 and L19 will now go to L4 and L20. The lead that originally went to L4 and L20 now goes to L1 and L17.

Because there are four different plugs that can be used in PS1 there are four different ways in which the information in the agency column can be distributed among the four groups of buildings. This is also true of the information distributed by the meeting place column, the name column, and the password column.

Further variety in the information distribution circuit is provided by the plugs used in PS5, PS6, PS7, and PS8. These plugs serve the purpose of scrambling the information within each group of buildings.

For example, if the P1 plug were removed from PS5 and replaced by a P2 plug, electrical contacts J1 and J2 which originally gave information from the agency column will now display information from the meeting place column. J3 and J4 which originally displayed meeting place information will now display name information. J5 and J6 which originally displayed name information will now display password information. J7 and J8 which originally displayed password information will now display agency information.

If the plugs in PS6, PS7, and PS8 were also changed, the information distribution within the second, third, and fourth groups of buildings would also be rearranged.

By filling the sockets PS1 through PS8 in a random fashion before each game a great variety of informational combinations is possible and its exact nature and location would be impossible for a player to predict.

It will be noticed that in the information distribution circuit only the first eight contacts of PS2, PS3, and PS4 are used. Of the 16 remaining contacts of each of these sockets, the first eight control the "Gold Award" circuit so that it precisely agrees with the information circuit, and the last eight contacts of each of these sockets control the "Green Award" circuit so that it precisely agrees with the information circuit. The wiring diagrams of P5, P6, P7, and P8 will show that on each individual plug, the three groups of eight contacts are wired in identical manner. This design insures that for whatever change the plug may cause in the information distribution circuit, it causes an exact same change in both the "Gold" and "Green" award circuits.

Because the information distributed by PS1 merely identifies the groups and does not otherwise affect the logic of the "Gold" or "Green" awards, it is not necessary to have additional contacts on this socket. However, the information distributed by PS1 is tied into the "Gold" and "Green" logic circuits through the initial contacts of PS9 and PS10. PS9 is the socket which determines which group will represent the "Gold" award agent and PS10 is the socket which determines which group will represent the "Green" award agent.

There are only four plugs which can be used in PS9 and PS10, and each plug represents one of the four groups of buildings. The wiring diagram will show that if plug P9 were used in socket PS9, B plus (positive) entering through any of the electrical contacts J33 through J38 (because a spy character is in "Le Bistro Henri") would light either L35 or L36 (depending upon which panel the spy belongs to) and would also enter the first contact of PS9 and go straight through to the lead which connects with the first contact of PS1. Of course, only the lamp on the energized panel would light, but since these lamps are the same ones that would be lighted if a spy character energized the lead to the first contact of PS1 from a position in the first group of buildings, the indication is that this group of buildings is the one associated with the "Gold Award".

If plug P10 occupied PS9, the voltage would find its way to the lead which enters PS1 from the second group of buildings. Plug P11 would connect to the lead from the third group of buildings and P12 would connect to the lead from the fourth group of buildings.

These plugs operate in the same manner to display information regarding the "Green Award" when inserted into socket PS10 except that electrical contacts J39 through J44 in "Auberge de Paris" are used and the agent indicator lamps are the "Green" agent lamps L37 and L38.

If panel No. 1 is energized and the "Gold Award" switch is activated (SW6 is thrown from the normally off position as shown on the schematic to the "ON" position), the "Gold" logic circuit will begin at the point where B plus (positive) DC voltage from SW1 enters the middle pole of SW6 (SW6, SW7, SW8, and SW9 are three pole double throw switches). In the activated position, the middle pole of SW6 feeds the voltage to a lead that goes to the "Gold Award" lamp L41 with its resistor R1 in parallel. From this point the voltage is applied to both the input to the alarm and the sixth contact on PS9. If PS9 is occupied by a P9 plug the voltage proceeds to the seventh contact on PS9 which is connected to a circuit associated with the first group of buildings (a P10 plug would feed the voltage to the eighth contact on PS9 which is associated with the second group of buildings, a P11 plug would feed the voltage to the ninth contact on PS9 which is associated with the third group of buildings, and a P12 plug would feed the voltage to the tenth contact on PS9 which is associated with the fourth group of buildings). From the seventh contact on PS9 the lead goes to the ninth contact on PS2 (this is the first contact in the second group of eight contacts on PS2). If PS2 is occupied by a P5 plug, the frist group of buildings will have indicated the "Moulin Rouge" (lamp L5) as the meeting place and the ninth contact of PS2 will agree with this by feeding the voltage through to the tenth contact of PS2 which is connected to the electrical contacts in the "Gold" half of "Moulin Rouge" (J81 through J86). The other contacts of PS2 will lead to the various night clubs but in this case only the "Gold" half of "Moulin Rouge" will have a voltage applied to it.

If the spy character is in the correct meeting place (the "Gold" half of "Moulin Rouge") it will be in one of the electrical contacts (J81 through J83) which are associated with panel No. 1. The spy character closes the circuit through the electrical contacts it is occupying which feeds the voltage through to a lead going to the third pole of SW1 (SW1 is a six pole three position switch with the center an "OFF" position. The first position makes contacts for panel No. 1 and the third position makes contacts for panel No. 2.). Since SW1 is in the position to activate panel No. 1, the voltage is fed to a lead going to SW2 (the name switch on panel No. 1). If the operator has set SW2 to the name indicated by the first group of buildings, the voltage will be fed through to a contact on PS3 which agrees with the name indicated by the first group of buildings. If PS3 is occupied by a P5 plug, the name indicated would be "Cluade" (lamp L9). With SW2 at its first position (Claude), the voltage goes to the tenth contact on PS3. With PS3 occupied by a P5 plug the voltage goes to the ninth contact of PS3 and from there to a lead going to the twelfth contact of PS9. With PS9 occupied by a P9 plug the voltage goes through to the eleventh contact of PS9. From the eleventh contact of PS9 the voltage goes to the third "OFF" position contact of SW7 on panel No. 1. Since SW7 is in the "OFF" position, the third pole carries the voltage to a lead going to the fourth pole of SW1. Since SW1 is in a position to activate panel No. 1, the voltage finds its way through SW1 to a lead going to the third pole of SW6. Since SW6 is in the activated position the voltage goes through the third "ON" contact to a lead going to the sixteenth contact of PS9. Since PS9 is occupied by a P9 plug, the voltage goes through to the seventeenth contact of PS9. From the seventeenth contact of PS9 a lead goes to the ninth contact of PS4. If PS4 is occupied by a P5 plug, the voltage will be fed to the tenth contact of PS4 and from there to a lead agreeing with the password displayed by the first group of buildings (Liberte, lamp L13). This lead goes to the first contact on SW4 (password switch on panel No. 1) which is labeled "Liberte". If the operator has set the password switch (SW4) to the correct password, the voltage will find its way through a lead to the first "On" contact of SW6 on panel No. 1. Since SW6 is in the activated position, the first pole will take the voltage from the first "On" contact to the B minus (negative) lead from SW1.

This completes the "Gold" logic circuit. With the spy in the correct location and with the name and password switches correctly set, the logic circuit represents a "short" around the alarm so that no voltage appears across it. Lamp L41 and its parallel resistor R1 are in series with the logic circuit so that the entire power supply voltage appears across them causing the lamp (L41) to light.

In the event that there were some error in the logic circuit, such as the spy being in the wrong location or the name or password switch incorrectly set, the logic would be "Open" (usually a dead end at PS9) and no short would appear across the alarm. In this case, lamp L41 and its parallel resistor R1 are in series with the alarm. The purpose of R1 is to reduce the combined resistance of L41 and R1 to a small value in comparison with the resistance of the alarm. With the alarm presenting the larger of the two resistances in series, the greater portion of the voltage will be dropped across the alarm causing it to operate. The lamp L41, however, would not receive enough of the voltage to cause it to light. Consequently, in the case of an incorrect logic circuit, the award lamp does not light and the alarm sounds.

It should be noted that that portion of the logic circuit which goes from PS9 to the third "Off" position of SW7, then to the fourth pole of SW1, then back to the third pole of SW6 is necessary to break up parallel logic circuits existing in the "Green" award circuit and also on the "Off" panel (panel No. 2). These switches make it possible to complete only one award circuit at a time. Without these switches, it would be possible under some circumstances to obtain a "Gold" award using the "Name" and "Password" designated for the "Green" award or, vice versa, a "Green" award using the "Name" and "Password" designated for the "Gold" award.

It should also be noted that that portion of the logic circuit which goes from the night club electrical contacts to the third pole of SW1 and from there to SW2 is designed to prevent voltages from finding their way from the activated panel through possible "sneak paths" to the "Off" panel and causing illegimate displays.

With the exception of those on SW4 and SW5 (password switches), all of the diodes in the circuit are for isolation purposes only. These diodes prevent voltages from finding their way from the activated panel through "sneak paths" to the "Off" panel and causing illegimate displays.

In addition to purposes of isolation, the diodes on SW4 and SW5 (password switches) serve as part of the logic circuit by determining whether or not the alarm will sound. For example, if the logic is correctly set when the contact switch is closed, the voltage on the alarm side of the diodes will be the same as that at the pole of the password switch and no conduction will take place through the diodes, consequently the alarm will not sound. On the other hand, if the logic is not correctly set, the voltage on the alarm side of the diodes will be more positive than that at the pole of the password switch and whichever diode is in contact with the pole of the password switch will conduct causing the alarm to sound. If it were not for these diodes, a password switch set at the wrong password or a voltage reaching the password switch by an incorrect logic circuit could cause an illegimate award to be made instead of sounding the alarm.

The "Green" award logic circuit operates in parallel and in a similar manner to that of the "Gold" award logic circuit, except that lamp L42 and resistor R2 are the award indicator and socket PS10 and its plug control the logic. It is activated by SW7 on panel No. 1 or SW9 on panel No. 2.

While the invention has been described by means of a specific example and in a specific embodiment, I do not wish to be limited thereto, for obvious modifications will occur to those skilled in the art without departing from the spirit and scope of the invention.

I claim:

1. Game apparatus, comprising a housing of substantially rectangular parallelepiped configuration having a top and a bottom in spaced substantially parallel relation, a first pair of sides in spaced substantially parallel relation substantially perpendicular to the top and bottom and a second pair of sides in spaced substantially parallel relation substantially perpendicular to the top and bottom and to the first pair of sides;

a pair of display panels each at a corresponding one of the first pair of sides of the housing and each having a plurality of display lamps thereon positioned in spaced relation in rows and columns, a pair of rotary switches thereon, a pair of ON-OFF switches and a pair of color indicating display lamps;

a first plurality of spaced electrical contact sockets positioned in a predetermined arrangement on the top of the housing;

a second plurality of spaced electrical contact sockets positioned on one of the second pair of sides of the housing;

a source of electrical energy in the housing;

memory means in the housing;

electrical circuit means electrically connecting the second plurality of contact sockets to the memory means and electrically connecting the first plurality of contact sockets and the lamps and switches of the display panels in a plurality of circuits via the memory means and the source of electrical energy;

a plurality of electrical contact plugs each removably insertable into any of the first plurality of contact sockets to make electrical contact therewith and thereby close selected ones of the circuits; and a plurality of programming means each having electrical contact plugs and each removably insertable into selected ones of the second plurality of contact sockets to program the memory means.

2. Game apparatus as claimed in claim 1, further comprising alarm means connected in circuit via said electrical circuit means for indicating an incorrectly completed circuit when the circuits are incorrectly completed.

3. Game apparatus as claimed in claim 1, wherein each of the plurality of electrical contact plugs comprises a housing of electrically insulative material having a plug extending from a surface thereof substantially perpendicular thereto.

4. Game apparatus as claimed in claim 1, wherein each of the programming means comprises a housing of electrically insulative material having programming circuitry therein and a plug electrically connected to the programming circuitry and extending from a surface of the housing substantially perpendicular thereto.

5. Game apparatus as claimed in claim 1, further comprising play money.

* * * * *